US005181340A

United States Patent [19]

Lindgren et al.

[11] Patent Number: 5,181,340

[45] Date of Patent: Jan. 26, 1993

[54] WINDOW WITH A MAIN FRAME FOR INSTALLATION IN AN INCLINED ROOF AND TWO OPENABLE WINDOW FRAMES

[75] Inventors: Claes Lindgren, Farum; Brent Moller, Gentofte; Flemming O. Petersen, Bloustrod; Stig F. Vigenberg, Gilleleje, all of Denmark

[73] Assignee: V. Kann Rasmussen Industri A/S, Soborg, Denmark

[21] Appl. No.: 688,548

[22] PCT Filed: Feb. 15, 1989

[86] PCT No.: PCT/DK89/00029

§ 371 Date: Jun. 21, 1991

§ 102(e) Date: Jun. 21, 1991

[87] PCT Pub. No.: WO90/09493

PCT Pub. Date: Aug. 23, 1990

[51] Int. Cl.[5] ..... E06B 3/34

[52] U.S. Cl. ..... 49/371; 49/248; 52/200

[58] Field of Search ..... 49/246, 248, 257, 258, 49/260, 261; 52/200

[56] References Cited

U.S. PATENT DOCUMENTS

| | | | |
|---|---|---|---|
| 1,427,175 | 8/1922 | Sylvan | 49/371 X |
| 1,796,113 | 3/1931 | McKee | 49/371 X |
| 4,098,024 | 7/1978 | Naka | 49/246 |
| 4,294,039 | 10/1981 | Dalheimer et al. | 49/248 |
| 4,672,774 | 6/1987 | Rasmussen | 49/371 |
| 4,838,111 | 6/1989 | Schmidt | 49/248 X |
| 5,037,230 | 8/1991 | Aumercier | 49/248 X |

FOREIGN PATENT DOCUMENTS

| | | | |
|---|---|---|---|
| 0178975 | 4/1986 | European Pat. Off. . | |
| 0179509 | 4/1986 | European Pat. Off. . | |
| 219026 | 2/1910 | Fed. Rep. of Germany | 52/200 |
| 2488322 | 2/1982 | France | 52/200 |
| 655970 | 5/1986 | Switzerland . | |
| 661083 | 6/1987 | Switzerland . | |

*Primary Examiner*—Renee S. Luebke
*Assistant Examiner*—Jerry Redman
*Attorney, Agent, or Firm*—Lane, Aitken & McCann

[57] ABSTRACT

In a window for installation in an inclined roof (1) the main frame (2; 3) includes a top-hinged upper window frame (12) and a bottom-hinged lower window frame (4) to be opened outwards into horizontal and vertical positions to form a shedroof above and a breast wall of a balcony-like enlargement. The lower frame (4) is hinged to the main frame (2; 3) in such a manner that its bottom section (4') in the open position is displaced downwards from the bottom section (2 ) of the main frame to reduce the height of the top edge of the frame above the latter bottom section.

2 Claims, 2 Drawing Sheets

Figure 1:
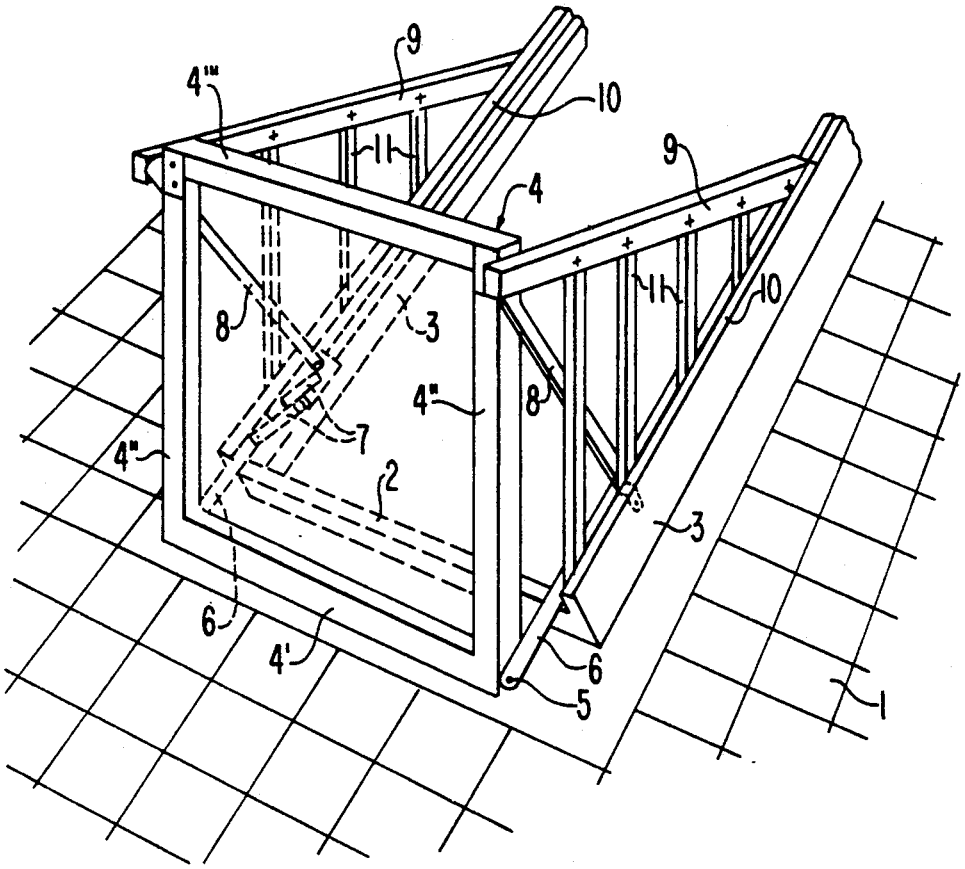

WINDOW WITH A MAIN FRAME FOR INSTALLATION IN AN INCLINED ROOF AND TWO OPENABLE WINDOW FRAMES

On the basis of the technical teaching derivable from DE GM 87 07 653 the invention relates to a window with a main frame for installation in an inclined roof and two openable window frames journalled therein which in their closed position are situated in extension of each other in the height direction of the main frame and together cover the main frame opening, and of which the upper one is top-hinged and the lower one is bottom-hinged to turn outwards into substantially horizontal and vertical open positions, respectively.

From said reference such a window arrangement does not directly appear but there is shown, on one hand, an embodiment with a window frame top-hinged at the top of the main frame in connection with openable panels or slats at the bottom of the main frame and, on the other hand, an embodiment with a bottom-hinged lower window frame in connection with a displaceable upper frame.

When the main frame is installed with its bottom member at a suitably low height above the floor in a top storey of a building, part of the closet space thereof may be used as a balcony or roof terrace when to two window frames are opened, the upper frame constituting a shedroof thereover and the lower frame constituting a breast or front wall to which side rails may be connected that are being unfolded and folded up upon opening and closing the lower window frame.

In window arrangements of the type referred to various conditions relating to safety, use and aesthetics must be fulfilled in order to obtain a satisfactory result. With respect to safety, it is thus a very frequently imposed condition that the height of the breast wall above the balcony floor is at least 1m, but at the same time the height must not exceed about 1.25m because a person standing on the balcony cannot otherwise comfortably rest his elbows on the upper edge of the breast wall. Moreover, the height from the floor to the top edge of the window should at least amount to 2m and should preferably be somewhat higher, meaning with a roof inclination of for example about 45° that the total height of the two window frames must amount to at least 3m. This implies that the height of the upper frame must be no less than 1.75m when the height of the lower frame is confined to 1.25m, meaning again that the upper frame becomes heavy and necessitates strong springs for fully or partially balancing the weight. A further inconvenience of the specified frame heights consists in that the frame members abutting on each other in the closed position of the window, i.e. the bottom member of the upper frame and the top member of the lower frame get a comparatively low position dissatisfactory to the view through the closed window.

In brief, it is an object of the invention to provide a window of the type concerned, but designed so that the relative heights of the upper and the lower frames may be decreased and increased, respectively, retaining at the same time a suitably low breast wall height of the lower frame in its vertically opened position.

This is obtained according to the invention in that the lower frame is hinged to the main frame in such a manner that its bottom section in the opened position of the frame is displaced downwards from the bottom section of the main frame and substantially parallel to the plane of the main frame. In a preferred embodiment of the window according to the invention this is obtained in that the bottom section of the lower frame is hinged at either side to the lower end of a supporting lever parallel to the main frame side member concerned and connected therewith through a pair of pivotal parallelogram joints, the frame side member being further connected with the main frame side member through an oblique stiffener or bar.

While the lower frame of the prior art window (FIG. 6 in said GM reference) is bottom-hinged with a stationary axis, the corresponding axis of the window according to the invention is in the installed position of the window actually displaceable obliquely downwards from the main frame so that the height of said frame may be increased without increasing the breast wall height and the height of the upper frame may be correspondingly reduced, thereby reducing its weight and concurrently the frame members abutting on each other in the closed position of the window obtain a less hampering location in the window.

Figure 2:
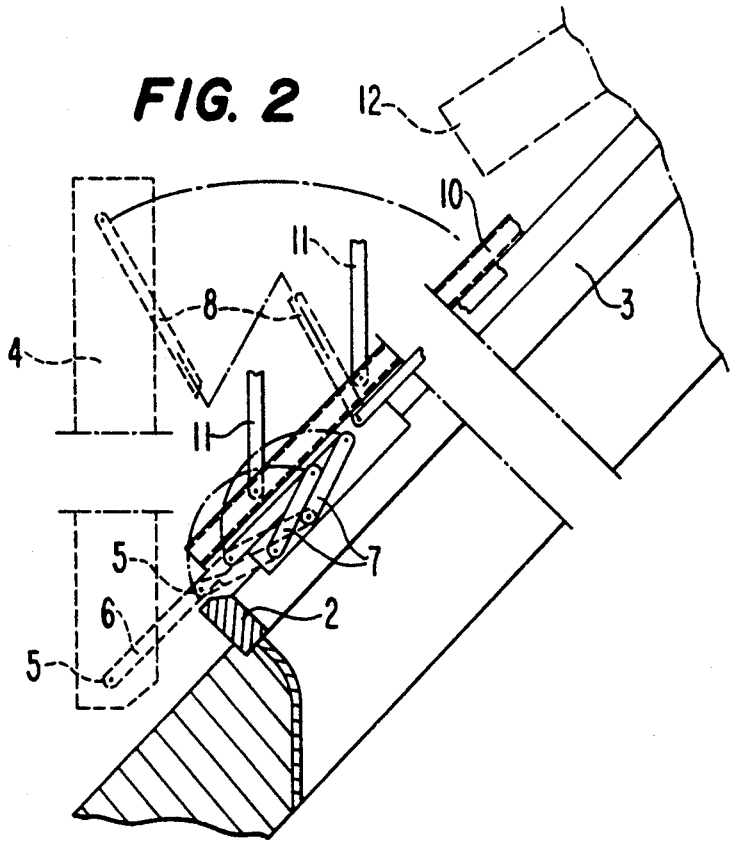
Figure 3:
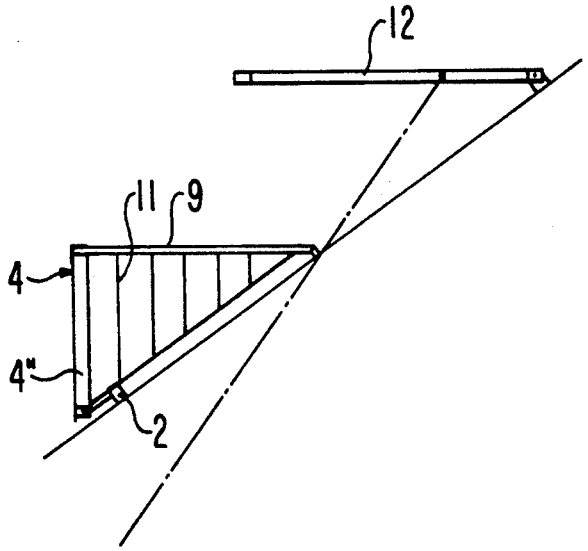

The invention will now be explained in detail by way of an embodiment with reference to the drawings, in which FIG. 1 is a perspective, sectional view of a roof with a window in opened position, only the lower window frame being shown; and FIG. 2 is a vertical, fragmentary section with the lower frame shown in fully opened position and the upper frame partially opened; and FIG. 3 is a schematic side elevation of the window in an open position.

Reference numeral 1 in FIG. 1 is a section of for example a slated roof with an inclination of about 45° and in which a main frame is installed having a bottom member 2 and two side members 3 as well as a top member not shown. A lower window frame 4 with a bottom member 4', two side members 4'' and a top member 4''' is at either side of its bottom through pins 5 hinged to the lower end of a supporting lever 6 parallel to the main frame side member 3 concerned and connected therewith through two pivotal parallelogram joints 7, thereby allowing the supporting lever 6, as depicted in FIG. 2, to be translatorily displaced between the position shown in solid lines, (corresponding to closed window) in which pin 5 is immediately adjacent the main frame bottom member 2, and the position displaced downwards along the roof surface, shown in dashed lines. In the vicinity of the to end each lower frame side member 4 is moreover connected with the corresponding main frame side member through an oblique stiffener or bar 8 to stabilize the lower frame 4 during and after opening to the illustrated vertical position in which, as explained above, it may constitute the front or breast wall of a balcony when the main frame bottom member 2 has a suitably low height above the floor in the room, not shown, under the roof 1. For the purpose of side limitation of such a balcony, two horizontal rail bars 9 are pivotally hinged at their forwards facing ends frame to the frame side members 4'' of the lower frame 4 are pivotally connected at their opposite ends with slides, not shown, which are displaceable in U-rails 10 secured to the upper side of the main frame side members 3. The horizontal bars 9 may, as shown, be supplemented with vertical rail bars 11 which upon closing the window are collapsed into the main frame together with the horizontal rail bars and the oblique stiffeners 8.

FIG. 2 moreover illustrates the lower section of the upper frame 12 of the window that may be pivotally hinged at its top side the main frame in an ordinary manner as known e.g. from U.S. Pat. No. 4,672,774 or published French Patent Application No. 2,488,322, and may be swung upwards to at least approximately horizontal position to form a shedroof above the balcony.

As shown in the schematic view in FIG. 3, the upper window frame 12 is top-hinged so that, when swung upwards to a mainly horizontal position, the upper window frame 12 forms a shedroof which partly covers the balcony formed by the lower frame 4, which has been swung outwards to its open position.

What is claimed is:

1. A window for installation in an inclined roof (1), comprising a main frame (2; 3) and upper and lower openable window frames (4; 12) journalled in the main frame one above the other to cover the main frame opening in their closed position, said upper openable frame being pivotally hinged to the main frame at its top side and said lower openable frame being pivotally hinged to the main frame at its bottom side to permit outwards turning of said upper and lower frames into substantially horizontal and vertical open positions, respectively, characterized in that the lower frame (4) includes a bottom section which is pivotally hinged to a supporting means which is connected with the main frame (2; 3) to allow downwards displacement of said bottom section (4') away from a bottom section (2) of the main frame in a direction substantially parallel to the plane of the main frame towards said vertical open position of the lower frame.

2. A window as claimed in claim 1, characterized in that said supporting means comprises two supporting levers (6) connected with opposite side members of the main frame through a pair of parallelogram joints (7) to extend substantially parallel to said side members, a bottom section (4') of the lower frame (4) being pivotally hinged at either side to the lower end of each of said supporting levers (6), a side member (4'') of said lower frame being further connected with a corrsponding side member of the main frame through an oblique stiffener bar (8).

* * * * *

UNITED STATES PATENT AND TRADEMARK OFFICE

CERTIFICATE OF CORRECTION

PATENT NO. : 5,181,340

DATED : January 26, 1993

INVENTOR(S) : Claes Lindgren, Brent Moller, Flemming O. Petersen and Stig F. Vigenberg

It is certified that error appears in the above-identified patent and that said Letters Patent is hereby corrected as shown below:

Column 1, line 27, "to" should be --the--.

Column 2, line 27, "and" should be deleted;

line 49, "to" should be --top--;

line 60, "frame" (both occurrences) should be deleted; and

Signed and Sealed this

Twenty-eighth Day of December, 1993

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,181,340
DATED : January 26, 1993
INVENTOR(S) : Claes Lindgren, et. al.

It is certified that error appears in the above-indentified patent and that said Letters Patent is hereby corrected as shown below:

Column 2, line 61, after "frame 4", --and -- should be inserted--.

Signed and Sealed this

Fifth Day of April, 1994

Bruce Lehman

*Attest:*

BRUCE LEHMAN

*Attesting Officer*

*Commissioner of Patents and Trademarks*